United States Patent [19]

Carnes

[11] 3,956,780

[45] May 18, 1976

[54] SLIDABLY MOUNTED CLOSET STRUCTURE

[76] Inventor: Don A. Carnes, 4261 Grange Hall Road, Holly, Mich. 48442

[22] Filed: Apr. 23, 1975

[21] Appl. No.: 570,745

[52] U.S. Cl. ..... 4/173 R; 312/228

[51] Int. Cl.[2] ..... A47K 3/00

[58] Field of Search ..... 4/175, 173; 312/228

[56] References Cited

UNITED STATES PATENTS

| | | | |
|---|---|---|---|
| 237,196 | 2/1881 | Martinez et al. | 4/173 |
| 342,531 | 5/1886 | Neuenschwauder | 312/228 |
| 566,197 | 8/1896 | Link | 4/175 |
| 1,651,443 | 12/1927 | Castanien | 4/175 |
| 1,792,696 | 2/1931 | Masters | 4/175 |
| 2,011,148 | 8/1935 | Hoehn | 4/173 |

*Primary Examiner*—Robert I. Smith

*Attorney, Agent, or Firm*—Gifford, Chandler & Sheridan

[57] ABSTRACT

A closet structure slidably mounted between a first and a second position for use in conjunction with a bathtub or the like. In the first position the closet structure is disposed vertically above and covers a bathing facility such as a bathtub. When the closet structure is shifted to its second position, the structure is laterally displaced from the bathing facility thereby uncovering the bathing facility and permitting use thereof.

4 Claims, 4 Drawing Figures

SLIDABLY MOUNTED CLOSET STRUCTURE

BACKGROUND OF THE INVENTION

I. Field of the Invention

The present invention relates generally to cabinets and more particularly to a slidably mounted cabinet movable between a first position disposed over the bathtub and a second position moved to a position uncovering the bathtub.

II. Description of the Prior Art

A great amount of time and effort has been expended in attempting to arrange the various necessary components of a motor home or the like to make the most efficient use of available space. Regardless of the arrangement there never seems to be space for a full size bathtub and if one is provided then there is not sufficient closet space.

SUMMARY OF THE PRESENT INVENTION

The present invention provides a bathroom arrangement for a mobile home or the like in which the space above the bathtub is utilized for a closet. Thus space which is orinarily wasted is put to use. This is accomplished by providing a closet structure which is slidably mounted in the space above the bathtub. When the bathtub is not in use the closet structure remains in place covering the tub. When it is desired to use the tub the closet structure is slid outwardly into the hall of the motor home or the like. The tub is then exposed with the back wall of the closet forming one wall of the room containing the tub. The closet structure can then be slid back into place without disturbing the contents thereof when use of the bathtub is completed.

BRIEF DESCRIPTION OF THE DRAWINGS

The slidable closet structure of the present invention will be more clearly understood by reference to the following detailed description when read in conjunction with the accompanying drawing wherein like reference characters refer to like parts throughout the several views and in which.

DETAILED DESCRIPTION

Figure 1:
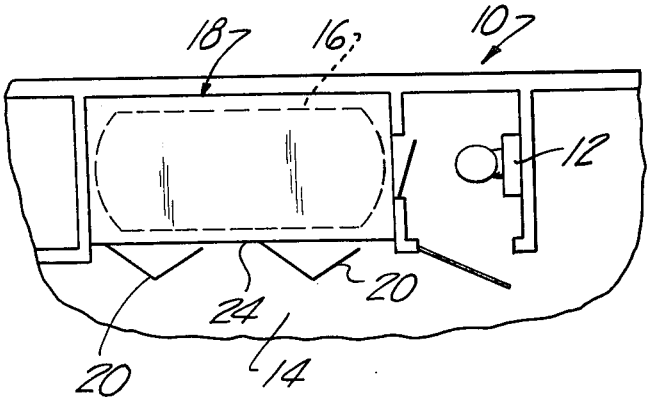
FIG. 1 is top plan view showing the closet structure in its first position.
Figure 2:
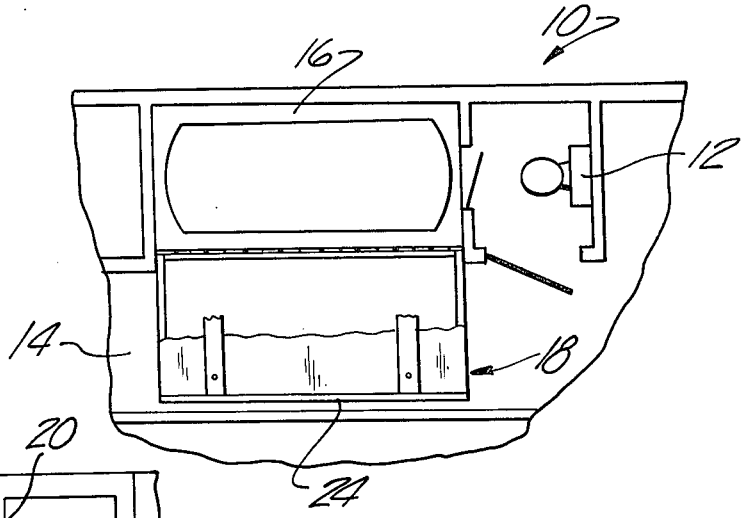
FIG. 2 is a view similar to FIG. 1 but showing the closet structure of the present invention in its second position.

Referring now to FIGS. 1 and 2, a portion of the interior of a motor home or the like is shown as including a bathroom 10 shown having a toilet 12, and a bathing facility 16. A hallway 14 is provided as is customary. Although the bathing facility 16 is illustrated as a bathtub it will be understood that the bathing facility 16 may be a shower stall or the like without deviating from the spirit of the present invention.

Figure 3:
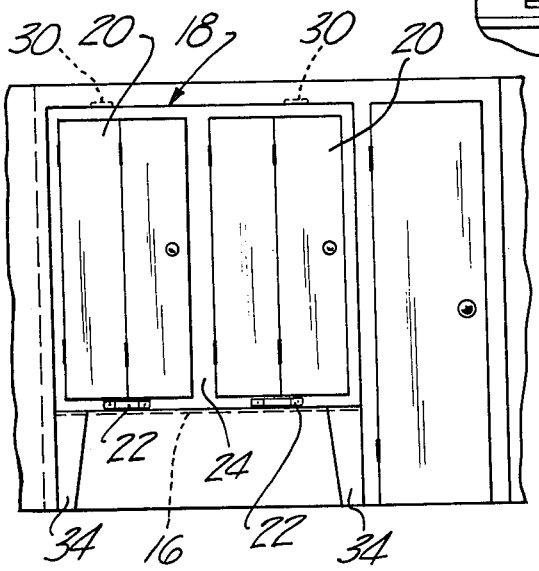
FIG. 3 is a front elevational view of the closet structure of the present invention.
Figure 4:
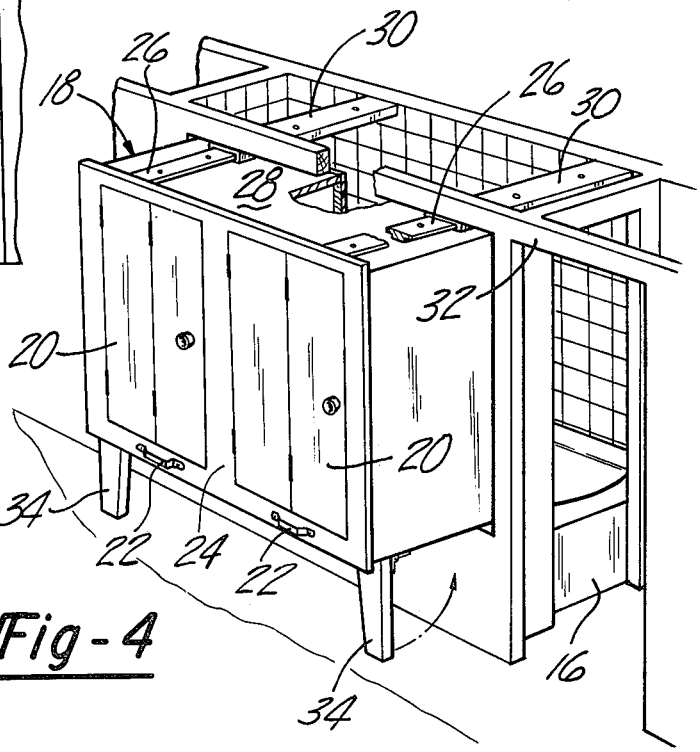
FIG. 4 is a perspective view of the closet structure in its second position.

The slidably mounted closet structure 18 of the present invention is best shown in FIGS. 2–4. The closet structure 18 is generally in the shape of a rectangular solid and is dimensioned to fit within the space above the bathing facility 16. The closet structure 18 includes doors 20 to permit access into the interior of the closet structure 18 and appropriate shelves, coat hangers or the like (not shown) are provided on the interior of the closet structure as required by the user. In addition handles 22 are secured to the front side 24 of the closet structure 18 for a purpose to be hereinafter better understood.

According to the present invention the closet structure 18 is slidable from a first position illustrated in FIG. 1 to a second position illustrated in FIG. 2. To effect this sliding movement, a pair of rails 26 are secured to the top surface 28 of the closet structure 18, as best shown in FIG. 4. A pair of corresonding rail carriers 13 are secured to the frame 32 of the motor home or the like and are adopted to receive the rails 26 therein. The key shaped rails 26 and C-shaped rail carriers 30 are shown by way of illustration only for it is to be understood that any conventional ail and rail carrier may be utilized with the closet structure 18 without deviating from the spirit or scope of the present invention.

It will also be appreciated that appropriate and conventional bearing means may be utilized between the rail 26 and rail carrier 30 for easy slidability of the closet structure 18.

The operation of the present invention may now be described as follows: With the closet structure 18 in its first position, as illustrated in FIG. 1, the closet structure 18 is disposed vertically above the bathing fixture 16. Thus when use of the bathing fixture 16 is desired, the user manually pulls the closet structure 18 by the handles 22 until the closet structure 18 is shifted to its second position which is illustrated in FIG. 2. With the closet structure 18 in its second position, the closet structure 18 is laterally displaced from the bathing facility thus uncovering the bathing facility 16 and permitting a bathing operation. It should be noted that with the closet structure 18 in its second position the hallway 14 is obstructed by as previously explained, this temporary obstruction is of little consequence. When the bathing operation is completed, the closet structure 18 is manually returnd to its first position so as to remove the obstruction from the hallway 14.

The closet structure 18 may also be provided with front legs 34 so as to maintain the closet structure 18 with a generally level position when the cabinet 18 is in its second position. The legs also function to reduce the stress on the rails 26.

Walls 24–26–28 are preferably provided as can best be seen in FIG. 2 and combine with the back wall 30 of the closet structure 18 to close off the room containing the bathing facility 16. A door 32 from the portion of the bathroom containing the toilet 12 may be provided in the wall 28 to provide access to the bathing facility 16.

Other improvements to the present invention will become readily apparent to those skilled in the art to which it pertains. For example, the closet structure 18 may be divided down a center vertical line so that only one-half the closet structure 18 need be shifted to the second position when the bathing facility 16 is used for a shower, while both halves of the closet structure 18 would be shifted to their second position when a bath, rather than a shower, is desired.

It can thus be seen that the slidable bathroom cabinet of the present invention provide-s a novel apparatus for utilizing the typically wasted space above a bathing fixture for a closet without adversely affecting the function of the bathing facility.

Having thus described my invention, many modifications thereto will become apparent to those skilled in the art to which it pertains without deviating from the spirit of the invention as defined by the scope of the appended claims.

I claim:

1. An apparatus comprising a closet structure, a bathing facility, and means including a frame for slidably mounting said closet structure between a first and second position, said closet structure in said first position being disposed vertically above and covering said bathing facility, said closet structure in said second position being laterally displaced from said bathing facility thereby uncovering said bathing facility so that said bathing facility may be utilized for bathing.

2. The apparatus defined in claim 1 wherein said bathing facility is a bath tub.

3. The apparatus defined in claim 1 wherein said closet structure is a clothes closet.

4. The invention as defined in claim 1 wherein said means for slidably mounting said closet structure comprises at least one rail secured to said closet structure and at least one rail carrier secured to said frame and adopted to receive and support said rail therein.

* * * * *